US005887398A

United States Patent [19]

Chen

[11] Patent Number: 5,887,398

[45] Date of Patent: Mar. 30, 1999

[54] SYNTHETIC DOOR CASEMENT STRUCTURE FOR PATIO DOORS AND LIKE, AND METHOD

[76] Inventor: Kuei Yung Wang Chen, 201, Tung Hwan Rd., Taipei, Taiwan

[21] Appl. No.: 818,997

[22] Filed: Mar. 17, 1997

[51] Int. Cl.[6] ..... E04C 1/40

[52] U.S. Cl. ..... 52/309.9; 52/455; 52/457; 52/309.11; 52/802.11; 49/501; 49/503

[58] Field of Search ..... 52/309.4, 309.9, 52/309.11, 455, 456, 457, 458, 802.1, 802.11; 49/501, 503

[56] References Cited

U.S. PATENT DOCUMENTS

| | | | |
|---|---|---|---|
| 3,950,894 | 4/1976 | Dimaio | 49/501 |
| 4,281,493 | 8/1981 | Pitt | 52/309.11 |
| 4,327,535 | 5/1982 | Governale | 52/309.11 |
| 4,374,693 | 2/1983 | Pitt | 52/309.11 X |
| 4,550,540 | 11/1985 | Thorn | 52/309.4 |
| 4,720,951 | 1/1988 | Thorn et al. | 52/455 X |
| 4,850,168 | 7/1989 | Thorn | 52/455 X |
| 4,860,512 | 8/1989 | Thorn | 52/309.11 |
| 4,864,789 | 9/1989 | Thorn | 52/309.9 |
| 4,901,493 | 2/1990 | Thorn | 52/455 X |
| 4,922,674 | 5/1990 | Thorn | 52/309.11 X |
| 4,965,030 | 10/1990 | Thorn | 264/46.5 |
| 5,022,206 | 6/1991 | Schield et al. | 52/456 X |
| 5,048,251 | 9/1991 | Turner | 52/456 |
| 5,074,087 | 12/1991 | Green | 52/455 X |
| 5,077,948 | 1/1992 | Olson et al. | 52/309.11 X |
| 5,161,346 | 11/1992 | Olson et al. | 52/309.11 X |
| 5,239,799 | 8/1993 | Bies et al. | 52/309.11 |
| 5,644,870 | 7/1997 | Chen | 49/501 |

*Primary Examiner*—Christopher Kent
*Assistant Examiner*—Yvonne Horton-Richardson
*Attorney, Agent, or Firm*—Joseph L. Strabala

[57] ABSTRACT

A synthetic door casement is composed of multiple panels of L-shaped compression molded skin panels, that can be embossed with a graining pattern on their outer surfaces, which are joined with batten means on their inner surfaces to form a pair of opposed rectangular casement skins which casement skins are then joined on opposite sides of an outer frame surrounding an inner frame to form a hollow rectangular casement which is then filled with a plastic foam, such as polyurethane foam, with the inner frame having an external recess to receive a glass pane along with cooperative retention moldings to hold the pane in place in the recess of the inner frame once the pane is inserted therein. In another embodiment, multiple panel strips are employed to construct the casement skins in place of the L-shaped skins and are also connected with batten means on the inside surfaces of the multiple skins to form the casement skins, wherein the batten means includes raised ribs on the inside surfaces of each panel and a metal coupling plate which is crimped on the aligned ribs.

10 Claims, 8 Drawing Sheets

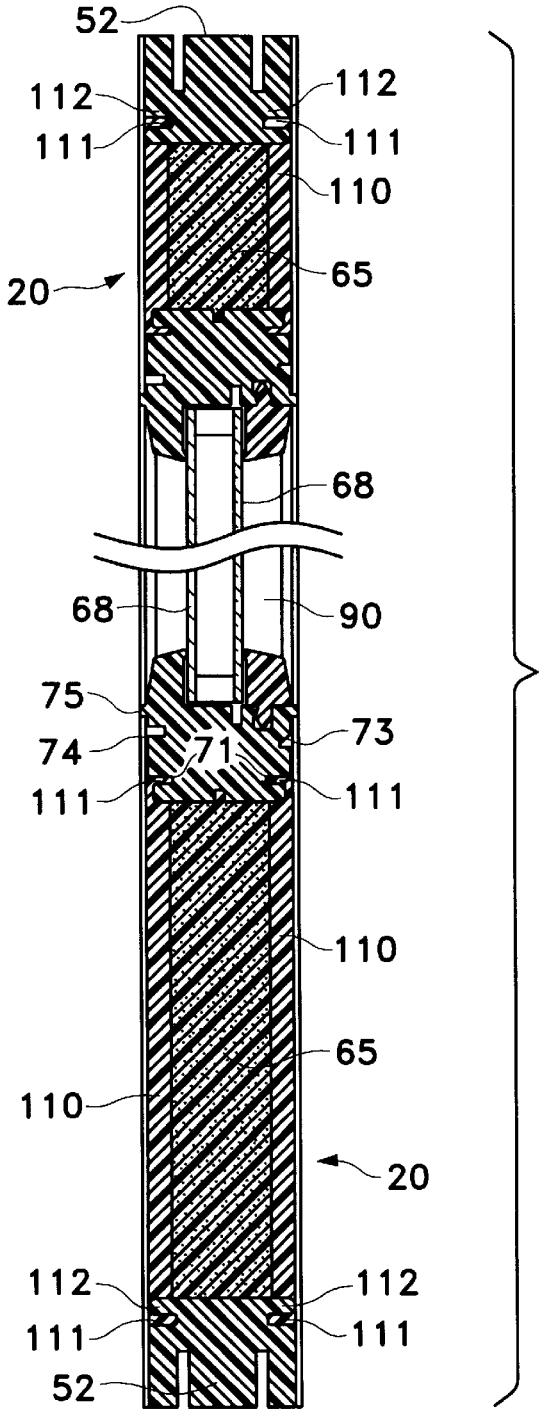
FIG. 7
FIG. 8
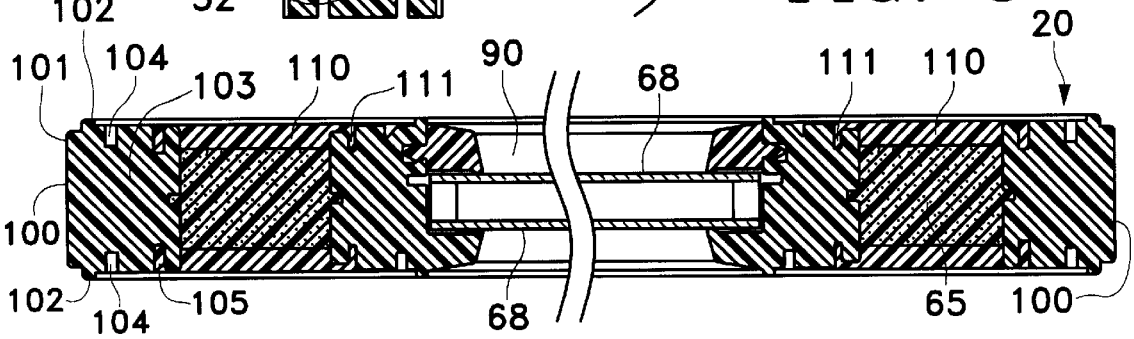

SYNTHETIC DOOR CASEMENT STRUCTURE FOR PATIO DOORS AND LIKE, AND METHOD

BACKGROUND

In the 1970 Owens-Corning Fiberglas introduced a door which was made with fiberglass skins composed of polyesters and glass fibers thin sheets. These sheet were then mounted on a rectangular frame composed of rails and stiles with adhesives and the resulting hollow core filed with a plastic foam, such as polyurethane foam. The product was a very viable door but its advantages, such as higher insulating values, were not enough to off set the high prices, even though the doors did not chip, crack or warp, according to a brochure published by the Owens-Corning Fiberglas at that time. In 1976 a patent issued to DiMaio, U.S. Pat. No. 3,950,894 which describes a synthetic door product, as a polyester door composed of two glass fiber reinforced polyester skins supported on a frame with the hollow core filled with a plastic foam.

Since the mid-1970's the costs of making fiberglass skins by sheet compression molding techniques have dropped appreciably even though such techniques have been known for some time, e.g. see U.S. Pat. No. 3,772,241 issued to Kroexel defining one type of molding composition for such processes, and doors made with such skins have become more competitive with natural wood products, which have actually increased in prices since the mid-1970s As a result there now is considerable interest in marketing synthetic door products produced by employing compression molded thin skins mounted on a frame with the hollow core between skins filled with a plastic foam.

Due to the potential of the market a number of patents have issued in this area, such as U.S. Pat. Nos. 4,550,540; 4,901,493; 4,965,030; 4,860,512 and 4,864,789 issued to Thorn, along with U.S. Pat. No. 5,074,087 issued to Green. Of course such structures are not limited to entry and exit doors in buildings but can also be used on cabinet doors and drawers, such as shown in U.S. Pat. No. 3,498,001 issued to McDonald and U.S. Pat. No. 3,402,520 issued to Lee.

U.S. Pat. Nos. 4,901,493 and 4,720,951 issued to Thorn teach insert of panels door casement made with compression molded skins, such as panes, which is the area to which this invention relates.

More particularly this invention involves the construction of door casements of synthetic materials using compression molded skins which have a large aperture for receiving a heavy pane of glass, such as double glazed glass panes, that are mounted on an outer frame and an inner frame to construct patio doors and the like, in which the resulting casements will have sufficient mechanical strength to support such heavy panes; the hollow rectangular core is filled with a plastic foam to increase the insulating qualities of the door casement and increase its overall integrity since the foam adheres to the inside surfaces of the skins.

An advantage besides the strength of the door casements, is the economics of constructing multiple sizes of such casements from the same small mold or molds.

Other advantages will be apparent from this specification when read in conjunction with the attached drawings illustrating the invention.

SUMMARY OF THE INVENTION

A novel door casement suitable for supporting large panes of glass according to this invention includes a pair of rectangular compression molded skins, each skin having a large central aperture formed therein, an outer rectangular frame composed of stiles and rails, an inner rectangular frame composed of stiles and rails positioned within the outer rectangular frame with the inner frame having vertical and horizontal dimensions less than the outer frame whereby there is a space between said stiles and rails of said frames, attaching means operable to secure said compression molded skins to the outer frame and the inner frame thereby forming a hollow rectangular core between the frames with the inner frame having a recess formed therein for receiving a pane, and also having molding means operable to hold said pane in said recess and plastic foam formed in said hollow rectangular core whereby the casement is capable of carrying the weight of the pane. The inner frame can also include projections which mate with the apertures in the skins to increase the strength of the casement, among other features.

DESCRIPTION OF THE DRAWINGS

The invention will be better understood, when reading the specification, by referring to the accompanying drawings, wherein:

FIG. 7 is a vertical section through the door casement with the central portion broken away, which casement is partially illustrated in FIG. 6;

FIG. 8 is a horizontal section through the door casement with the middle portion broken away, which casement is partially illustrated in FIG. 6;

DESCRIPTION OF A PREFERRED EMBODIMENT

Figure 1:
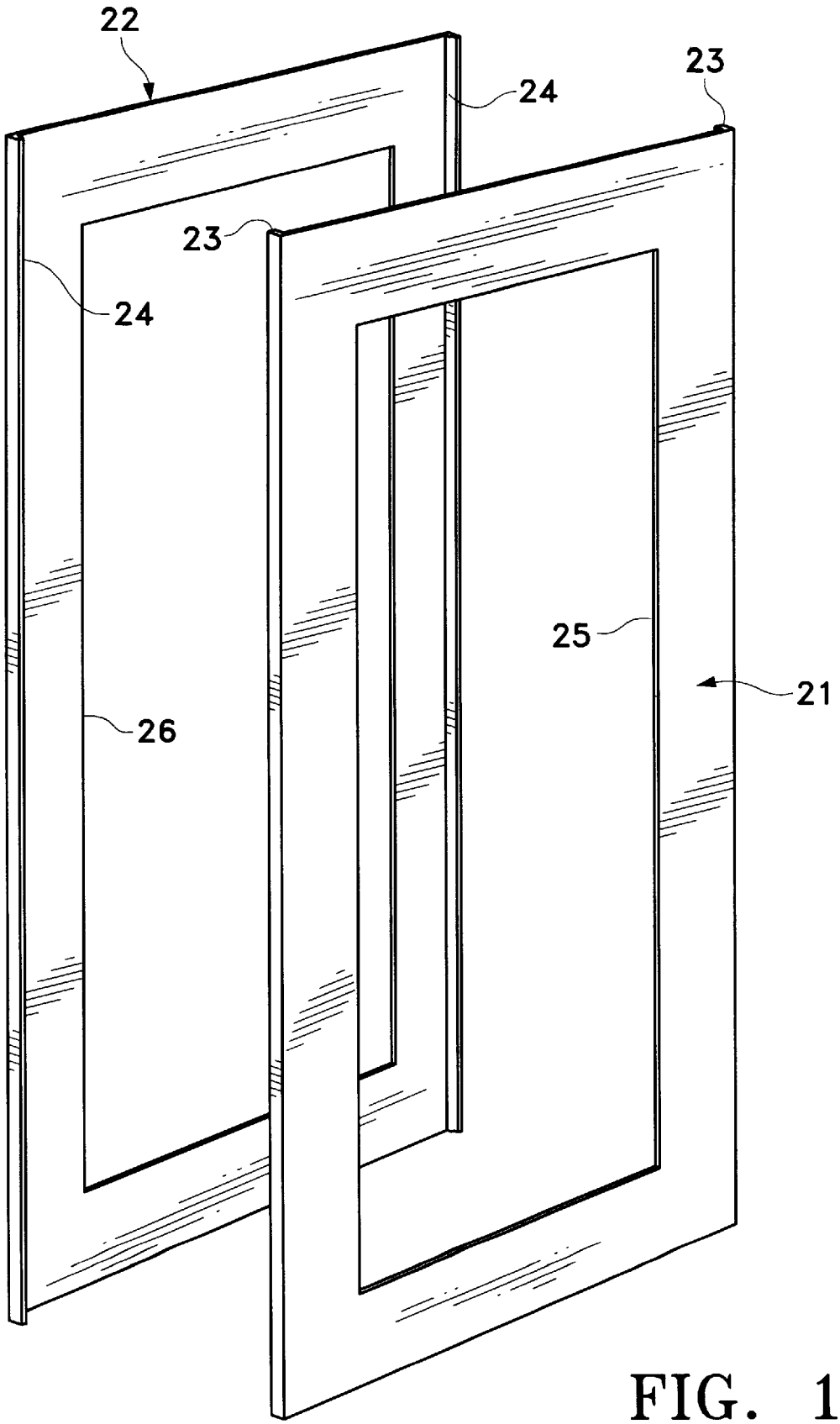
FIG. 1 is a perspective of two sheets of compression molded casement skins in a spaced apart relationship to illustrate how the skins will nest with one another using the interlocking edges shown.

As can be seen in FIG. 1 the door casement 20 can be made from two casement skins 21 and 22, each which has an integral edge, 23 and 24 respectively, which can be joined in an interlocking relationship when the two panels are nested. The novel edge closing relationship is described in my co-pending patent application, Ser. No. 08/490,125. As can be seen in the drawings each casement skin has a large rectangular aperture, 25 and 26 respectively.

The casement skins are formed by what is known as a "sheet compression molding process" wherein sheet molding compounds are placed between large dies and cured in heat and pressure, a process which has been known for a large number of years. It is described in publications, such as the Encyclopedia of Modern Plastics that has an yearly edition. In making skins for synthetic door products, such as this invention, the thickness of skins, made according to such a process which have a thickness in a range between 0.040 inches to 0.125 inches are quite satisfactory.

The sheet molding compounds are traditionally a class of materials known as molding resins, such as unsaturated polyester resins blended with vinyl monomers which often include fillers such as calcium carbonate and alumina trihydrate, plus from 15% to 40% by weight of glass fiber reinforcements. Such compounds are commercially available, see Encyclopedia of Modem Plastics.

Viewing FIG. 1 it can be appreciated that a rather large mold is required to make the casement skins 21 and 22 and that a separate or different mold would be required for each size door; e.g., 2 foot 6, 2 foot 8 and 3 foot in widths. According to one embodiment of this invention with only one or two relatively small molds, a door casements can be made to these various sizes using the same molds. This is accomplished by making L-shaped panels which thereafter are joined to make the casement skins 21 and 22. The only reason that two molds may be required is to form the integral edges on the casement skins 23 and 24 respectively, one edge which mates with the integral edge of the other casement skin when each of these edges are of a different configuration.

Figure 2:
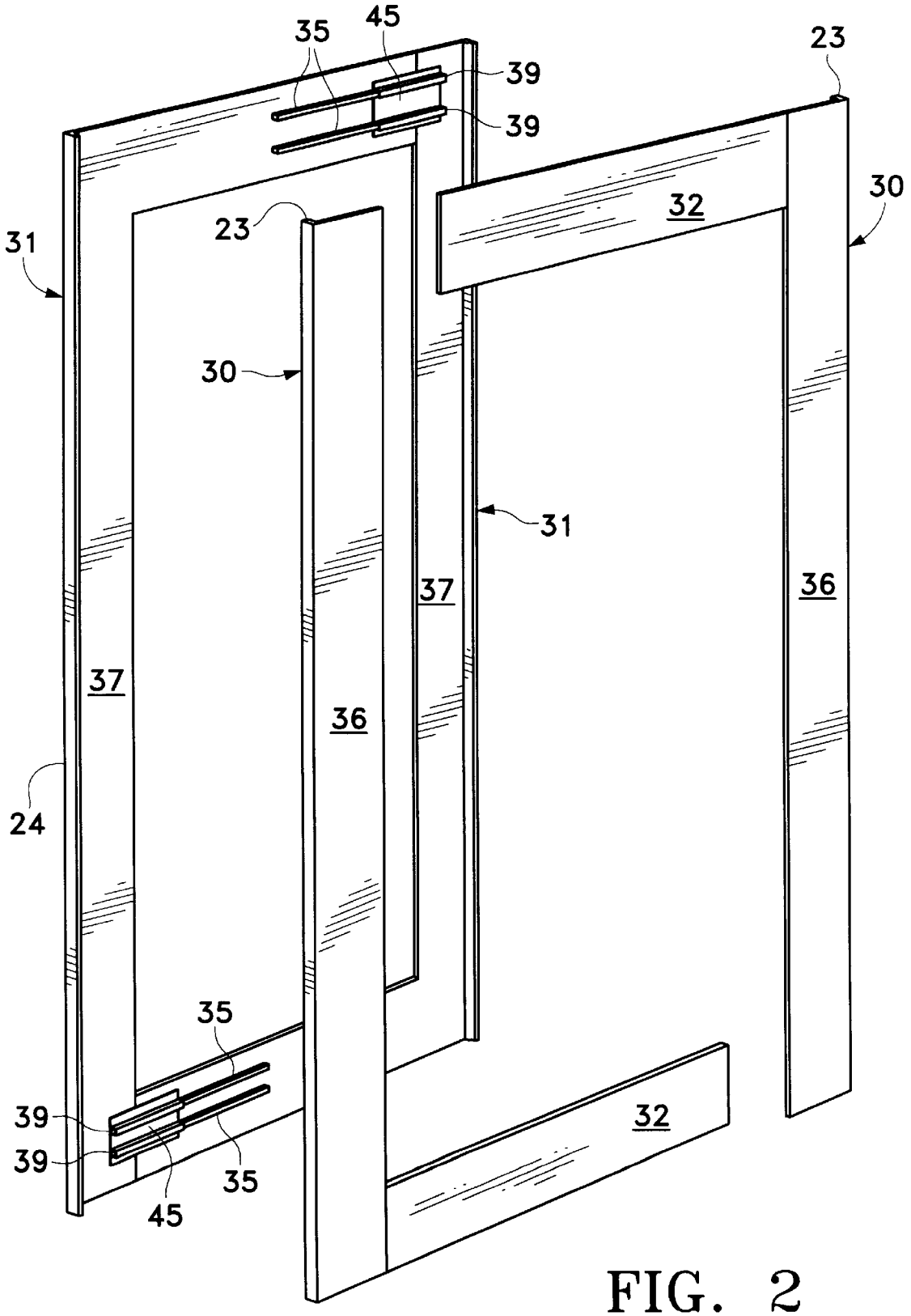
FIG. 2 is a perspective of the casement skins shown in FIG. 1 where the skins are made of L-shaped skin panels, with one of the casement skins exploded, which illustrates how the skin panels are joined with batten or coupling means.
Figure 3:
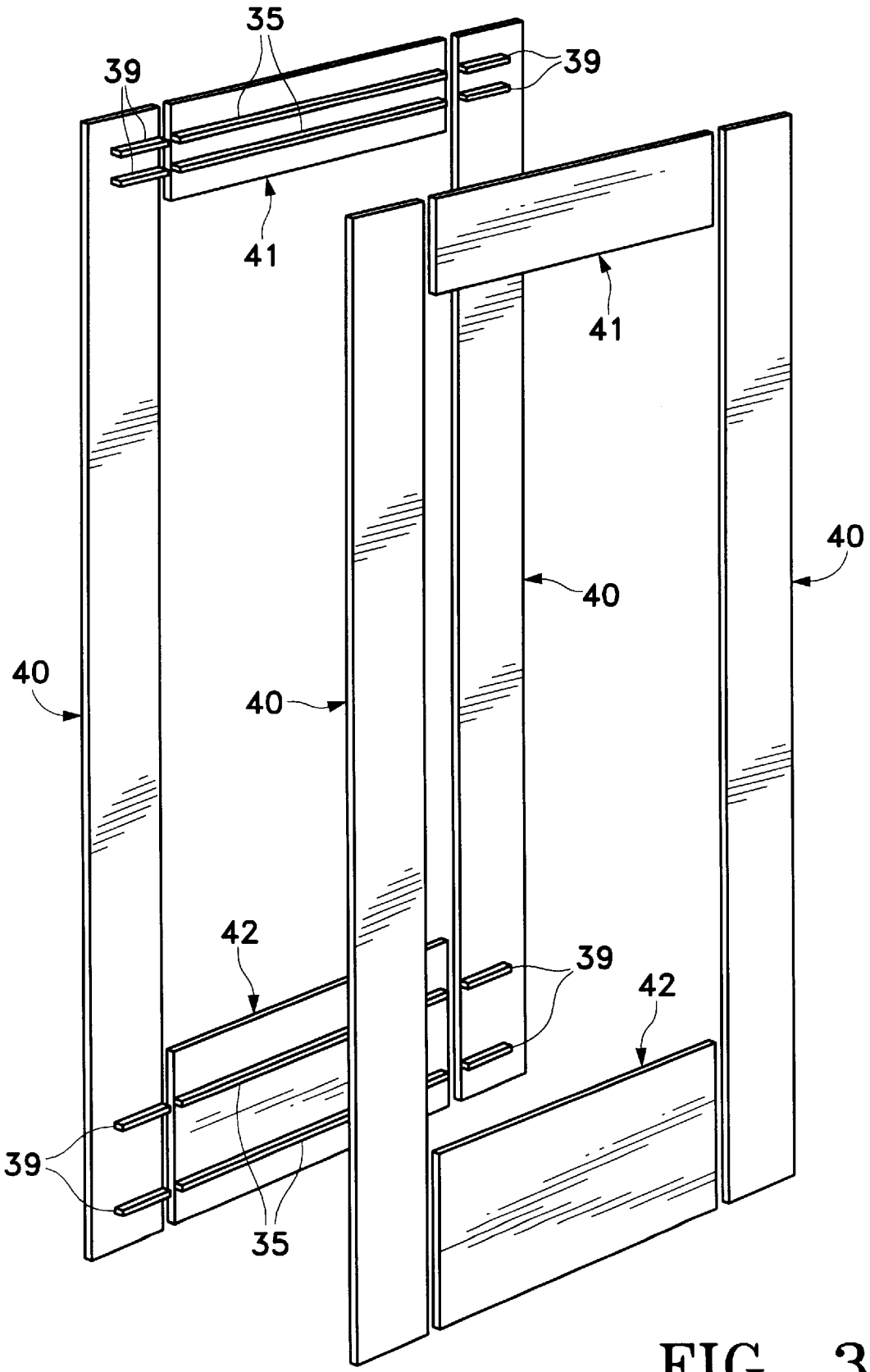
FIG. 3 illustrates in perspective, in explode detail, the casement skins made up of multiple skin panels, as opposed to the L-shaped panels illustrated in FIG. 2.

According to the preferred embodiment of this invention the casement skins 21 and 22 are formed by L-shaped skin panels, as shown in FIG. 2, which are joined to make these casement skins. Since the doors are of a uniform height, it is possible to form ribs on the inside surfaces of the L-shaped skin panels, as can be seen in FIG. 2, which will align when the door casement is assembled regardless of the width of the door. Using the L-shaped skin panels 30 and 31 the short leg on each panel, 32 and 33 respectively, has two or more spaced apart elongated ribs, 34 and 35 respectively, which are formed on the inside surface when the skin is molded. These ribs are oriented axially on the short leg. On the long leg, 36 and 37 respectively, of each panel two or more short ribs 38 and 39 are formed when the L-shape skin panels are molded and these ribs are oriented normal to longitudinal axis of the leg and extend to the inner edge.

It can be appreciated that the short leg, 32 and 33 respectively, of each panel can be cut off so that door casements of 2 foot 6 inches, 2 foot 8 inches and 3 foot can be made from the same L-shaped skin panels 30 and 31. Two L-shaped skin panels 30 are used to make the casement skin 21 (one turned upside down in relationship to the other) and two L-shaped panels 31 are employed to make casement skin 22, both of which are shown in FIG. 1; obviously the panels can be mixed, i.e., skin panel 30 joined with skin panel 31. When using the described L-shaped panels the interlocking integral edges, 23 and 24 respectively, are present on the vertical edges of the casement skins. It therefore can be appreciated that if the interlocking integral edges are not employed, only one mold will be required to form the L-shaped panels necessary to construct both casement skins.

Figure 4:
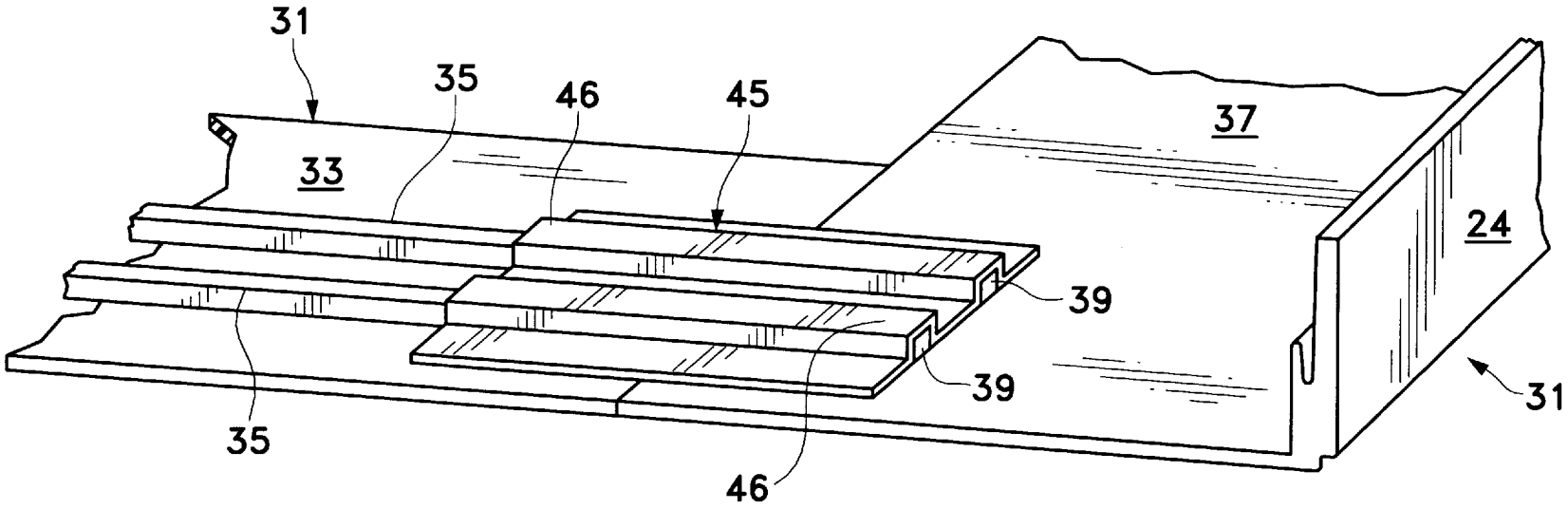
FIG. 4 is a broken away corner portion of one joints between the skin panels in perspective showing the batten connection in greater and enlarged detail.

In FIG. 4 still another embodiment is illustrated, in which strip skins are employed, the vertical strip skins 40 having the spaced apart short ribs 39 at their top and bottom inside surfaces and the top strip skin 41 and the bottom strip skin 42 both having elongated ribs 35 on their inside surfaces, as illustrated. Obviously the top strip skin 41 and the bottom strip skin 42 can be cut to different lengths to form doors of differing width, as described above.

Regardless of whether the L-shaped skin panels 30 and 31 are used or the strip skins 40, 41 and 42 are used, these panels are joined in the same way to make the casement skins 21 and 22. This joint or batten means is illustrated in greater detail in FIG. 4 wherein the ribs 35 and 39 are shown aligned with one another and a metal coupling plate 45 is crimped on the ribs to fasten the aligned panels together. Typically the metal coupling plate has two tunnels 46 formed therein which surround the respective ribs on the aligned panels when assembled thereon whereby it is possible to join the several panels in a permanent relationship, when the coupling plate is crimped on the ribs. Normally a bonding agent is placed between the two contiguous edges of the panels being joined so that a seam without gaps is formed. In addition the L-shaped panels may be scribed with a false joint or seam 47, see FIG. 5 (not shown in some of the other figures) to cause the appearance of a joint between the two legs of the L-shaped panels to match the actual joint made with the metal coupling plate described above. Further the ribs may be milled at the bottom to a narrower width, forming a dove tail in cross section, to aid coupling plate grip of the ribs and to increase the strength of the resulting joint. In addition the internal surfaces of the tunnels may include spikes (not shown) which sink into the ribs when the coupling plate is crimped thereon.

This coupling arrangement is quite important since double glazed glass panes placed in the completed door casement 20 have considerable weight and the skins must provide a degree of stiffening in order for the fabricated door casement to carry the loads.

Figure 5:
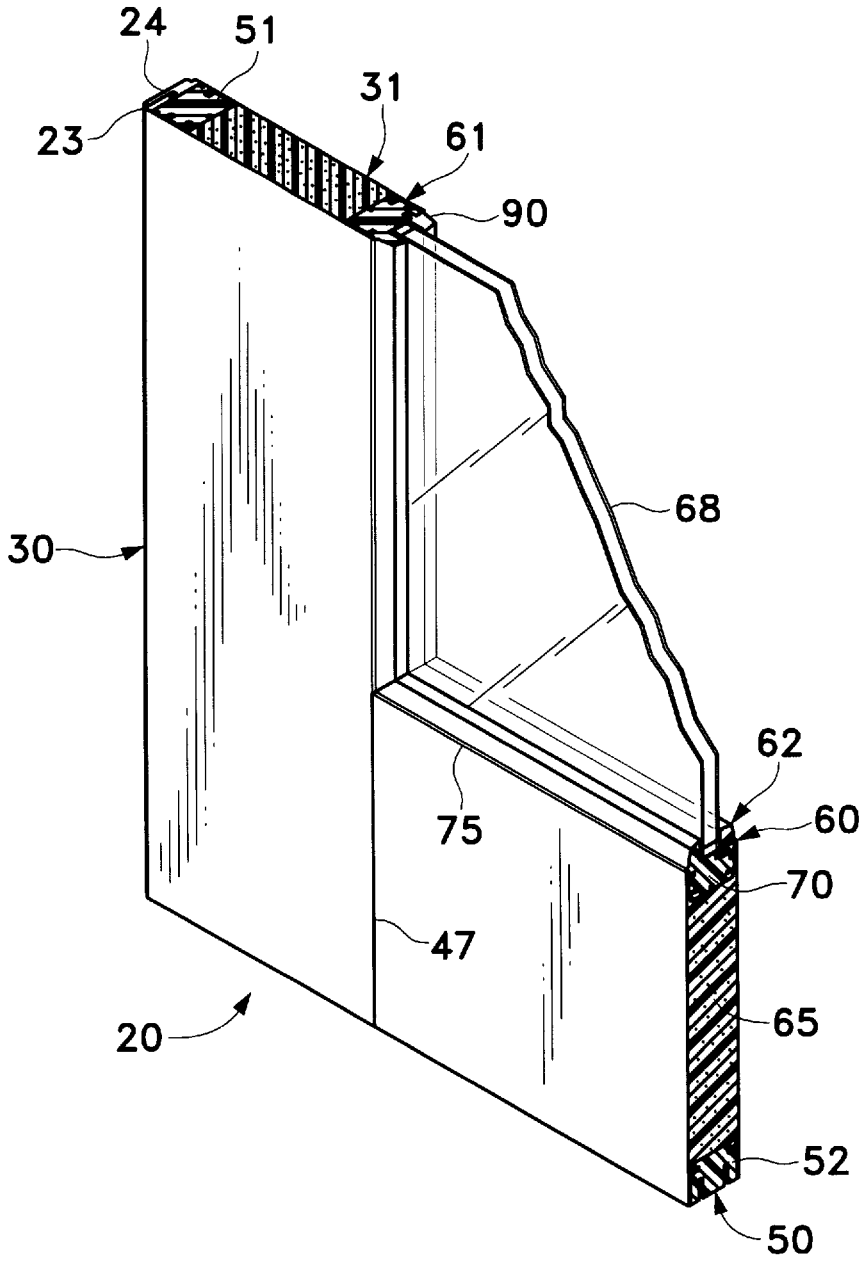
FIG. 5 is a perspective of a bottom corner of the door casement with the parts cut away to show the details of its internal structure when employing the casement skins with integral interlocking edges.

Actual construction of the door casement 20 can be better understood by reference to the perspective of its corner illustrated in FIG. 5. In this figure it can be seen that the L-shaped skin panels 30 and 31 are assembled with an outer frame 50 composed of a vertical stile 51 which lies just inside the interlocking edges 23 and 24 on these respective panels. This stile is positioned to engage a bottom rail 52 and a top rail 53 (see FIGS. 9 and 10 as well for these relationships). On the side opposite this stile is a matching vertical stile 54 (not shown) which together with the top and bottom rail completes the outer frame. The stiles and rails of the outer frame can be made of wood or plastic composites, which can be extruded plastics members. Normally the stiles are of wood and the rails are made of an extruded plastic such as poly vinyl chloride.

The inner frame 60 is a separate rectangular frame composed of two vertical stiles 61 and two horizontal rails 62. As can be seen this inner frame is much smaller than the outer frame 50 and is surrounded by the outer frame. It has mitered joints where the stiles and rails connect with one another, as best illustrated in FIG. 11. It is preferred that the stiles and rails of the inner frame be made of same extruded plastic material, which is typically poly vinyl chloride, with a very specific profile, best shown in FIG. 12.

Once the L-shaped skin panels 30 and 31 have been sized for the proper door width and joined to one another to form the casement skins 21 and 22, the casement skins are joined to the inner and outer frames. In the embodiment shown in FIG. 5, the interlocking edges 23 and 24 are coated with a glue (attaching means) as are the surfaces of the inner and outer frames, after which the casement skins are assembled thereon so the parts are glued together as a composite unit. This assembly leaves a hollow core between the two skins which is then filled with a plastic foam 65 in the same manner as taught by the prior art. A preferred foam in for the door casement is polyurethane foam. Also as illustrated in FIG. 5, is a pane 68, such a double glazed glass pane, which is supported by the inner frame 60.

Reference is now made to the cross section of stiles and rails forming the inner frame 60, which is illustrated in FIG. 12. In this drawing it can be seen that extrusion of which the stiles 61 and rails 62 of the inner frame are formed with a specific profile, which includes a rectangular body 70 that has a series of groves 71, 72 and 73 in its base 74 and a projecting flange 75 near its top 76 on each side thereof. The grooves 73 and 74 allow the excess glue to be channeled away from the glued surfaces, ensuring a better joint. The projecting flanges engage the inner edge aperture of the casement skins 21 and 22, locking the inner frame in apertures 25 and 26 when the door casement 20 is assembled. As can be seen the top of the body has a flat surface 77 that extends from one side thereof to vertical molding element 78, which together with the flat surface forms a recess in the stiles and rails of the inner frame for receiving the pane 68 which abuts against a sealing edge 79 on this element when the pane is inserted into the inner frame. The flat surface includes two grooves, an inner groove 80 and outer groove 81. The function of the inner groove is allow the portion 82 of the body move resiliently when a barb is inserted into the outer groove and then spring back locking the barb in the outer groove.

A molding strip 90 is fashioned as a mate for the molding element 78 and also includes a sealing edge 91 at the top 92 of the element and a barb 93 at its bottom 94. As can be seen in FIG. 12 the outer groove 81 is under cut so that it has an increased width near the base of the groove and the distal end of the barb on molding strip is enlarged, so that it is wider than the width of the top of this groove. As a result the sealing strip can be placed next to the pane 68 and the barb pressed into the outer groove whereby the pane is securely fixed in the inner frame. However, this relationship allows the molding strip be pried out of the outer groove if it is necessary to replace the pane mounted in the inner frame 60.

Figure 6:
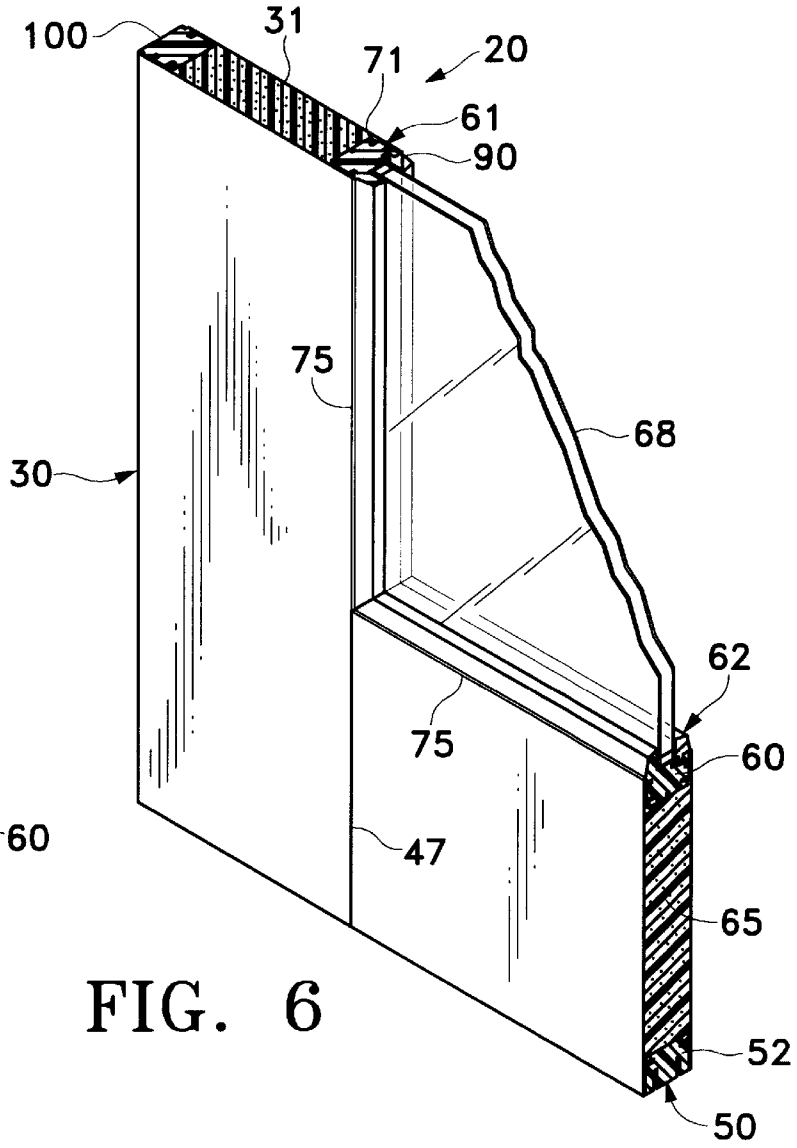
FIG. 6 a perspective, similar to FIG. 5, which illustrates how the vertical edges of the door casement are closed by frame members, as opposed to the interlocking edges illustrated in FIG. 5.
Figure 10:
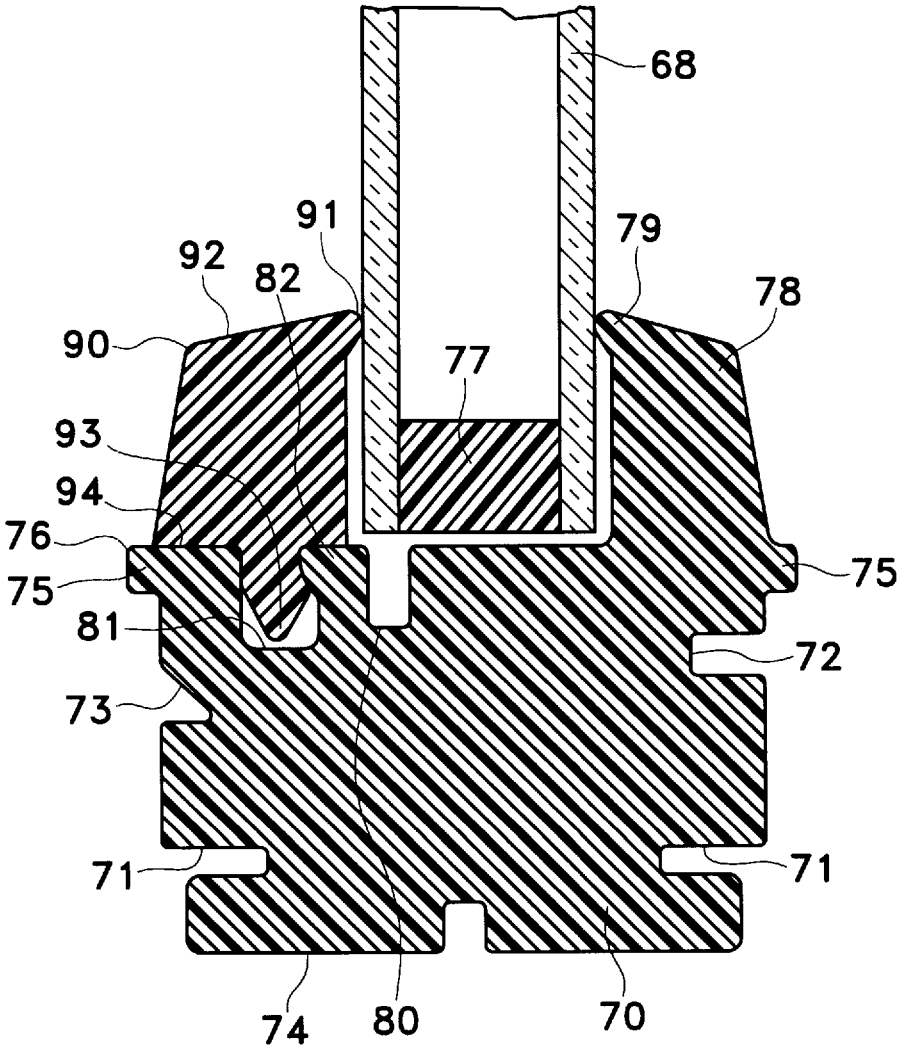
FIG. 10 is a cross section of the plastic extrusion used for forming the stiles and rails of the inner frame.

In FIG. 6 a door casement 20 is illustrated in which the panels making up the casement skins 21 and 20 are not equipped with the integral edges, 23 and 24 respectively. Instead a vertical stile 100 replaces these interlocking edges and the vertical stile 51 which is illustrated as a wooden stile in FIG. 5. The cross sectional profile of the stile is best shown in FIG. 10 in cross section. In this drawing it can be seen this stile, typically formed by a plastic extrusion process, includes a top 101 having a pair of projecting flanges 102 just below the top, one on each side of thereof. A base 103 is located just below the flanges and includes longitudinal grooves 104 on each side thereof that allow excess glue to escape from the surface during the gluing operation when the casement skins 21 and 22 are assembled to the frames. In addition it also has another pair of longitudinal grooves 105 on opposite sides thereof for receiving a strengthening element shown in FIG. 11 and described hereinafter.

By referring to FIG. 5 its can be appreciated that the interlocking edges 23 and 24 along with the vertical stile 51 just inside these edges, but usually spaced a small distance inwardly form these edges, work together form a solid support assembly for attaching the door casement 20 to hinges or the like on either side of the casement. This assembly along with the flanges 75 extending from the inner frame 60 which engage the inner edges of the apertures, 25 and 26 respectively, of the casement skins 21 and 22 allows the casement to carry the weight of double or triple glazed panes of glass.

Figure 9:
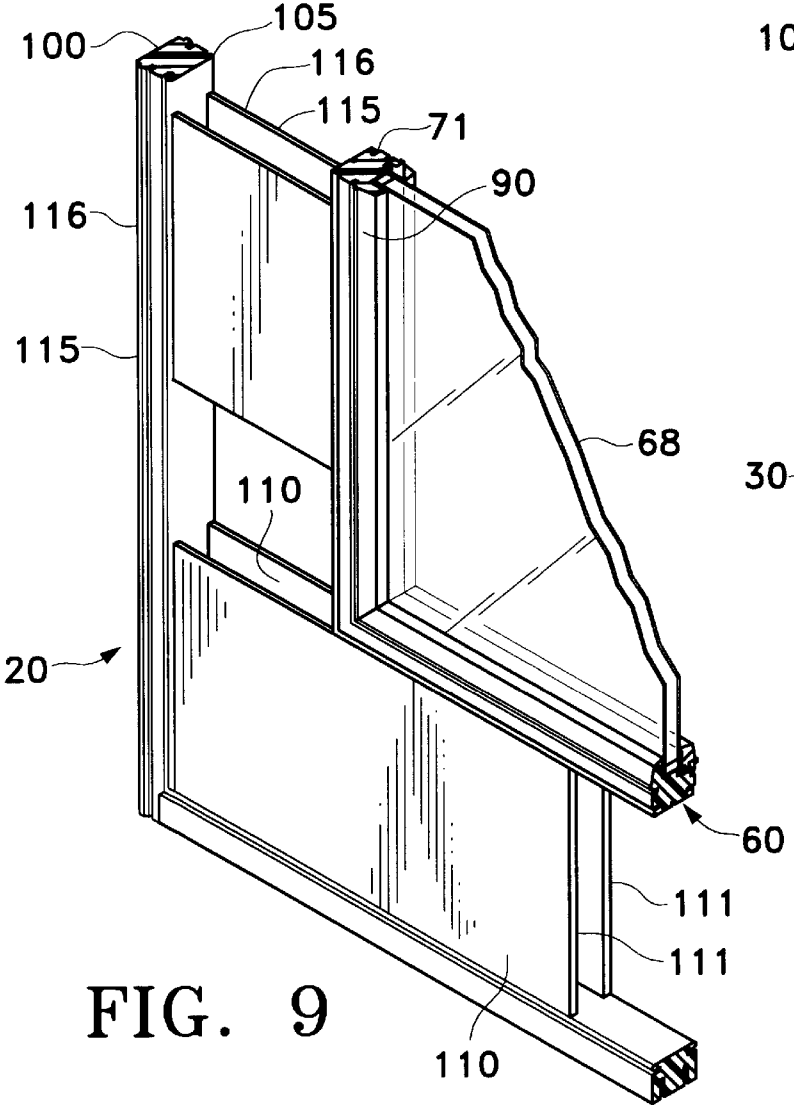
FIG. 9 is a perspective of the corner of door casement, without the casement skins and other parts broken away, illustrating reinforcement panels joining the outer and inner frames.

When the integral edges 23 and 24 are not employed in the construction of the door casement 20, as shown in FIGS. 9 and 10, some of the strength of the door casement is lost. To compensate for this loss in strength, metal reinforcing plates 110 are placed between the outer frame 50 and inner frame 60, as best illustrated in FIG. 11. These plates are flat pieces of iron, aluminum or the like which have thickness in the range of 0.02 inch to 0.12 inch, and have their peripheral edges bent normal to the surface so that an upstanding edge flanges 111 is formed around the plates. These edges are ported at the corners so that the flanges can be received by the grooves 105 in stiles 100 making up the outer frame 50 and the grooves 71 formed in the inner frame 60, locking them together as a unit. Both the stile of the outer frame and the stile 62 of the inner frame are relieved slightly so that when the reinforcing plates are installed these plates will be planer with the surface of the stiles so that these plates will not prevent the casement skins 21 and 22 from engaging the surfaces of these stiles.

It is also possible to have the flanges 111 of the reinforcing plates 110 engage the rails used the door casement 20, as shown in FIG. 9. This is accomplished by forming a longitudinal groove 112 or opposite sides of the top and bottom rails 52. As a result the reinforcing plate can be used on the corners of the door casement to increase the strength. Obviously in corners where the L-shaped panels are joined with the coupling plate 45, only one such reinforcing plate is employed. However, it can be appreciated that the coupling plate can be enlarged and equipped with flanges 111, so that it can be used to increase the strength in the same manner described.

Also, since the vertical stile 100 is the element to which the hinges are attached, it must carry the entire weight of the door casement 20 along with the panes placed in the inner frame. To insure there will be no failure when not using the integral edges 23 and 24, a smaller vertical reinforcing plate 115 in employed between the stiles 100 used to form the outer frame 50 and the stiles 62 used to form the inner frame 60 as depicted in FIG. 11. This plate has flanges 116, and multiple plates can be placed between these stiles on each side of the door casement in the area where the hinges will attach, thereby ensuring the glue joint will not be overtaxed by the attachment of the hinges.

The reinforcing plates 110 and 115 described do not require much space and they do not interfere with the in situ foaming of the polyurethane foam used to fill the rectangular hollow core of the door casement 20. Further the casement skins 21 and 22 hold these plates in the grooves 71 and 72 and the foam prevents them from moving longitudinally in the grooves. Thus there is no need to use special attachments for these elements beyond that achieved with the flange-groove interlock discussed.

As indicated the outer surfaces of the casement skins 21 and 22 may be embossed with wood graining when they are formed by compression molding. Such three dimensional graining is well known in the art and often formed by taking impressions form wood products, such as with a rubber mold, and then using the impression obtained thereby to form the pattern in the dies used for compression molding the skins for the door casement 20. Such graining on polyester skins was use by Owens-Corning Fiberglas on entry doors in 1976 and for the drawers disclosed in U.S. Pat. No. 3,950,894 reference above.

I claim:

1. A door casement suitable for supporting large panes of glass comprises:

a pair of rectangular compression molded skins, each skin having and a large central aperture formed therein;

an outer rectangular frame composed of stiles and rails;

an inner rectangular frame composed of stiles and rails positioned within said outer rectangular frame, said inner frame having vertical and horizontal dimensions less than said outer frame whereby there is a space between said stiles and rails of said frames;

reinforcing plate means connected between said outer frame and said inner frame operable to interlock said frames together as a unit so loadings on said inner frame will be partially transmitted to said outer frame though said reinforcing plate means;

attaching means operable to secure said compression molded skins to said outer frame and said inner frame thereby forming a hollow core between said frames and said skins;

said inner frame having a recess formed therein for receiving a pane, and also having molding means designed to hold said pane in said recess; and plastic foam formed in said hollow core operable to fill core with foam whereby said door casement has sufficient strength to support heavy panes.

2. The door casement defined in claim 1 wherein the compression molded skins have a imitation wood graining pattern on at least part of their outer surfaces.

3. The door casement defined in claim 1 wherein the inner frame has raised rib projections on its stiles and rails which engage the inner edges of the skins about their respective apertures formed in said compression molded skins to increase the strength of said door casement where said skins are joined to said inner frame by the attaching means.

4. The door casement defined in claim 1 wherein the said compression molded skins have integral edges along at least one vertical peripheral exterior edge which are oriented normal to the surfaces of their respective skins, said integral edges operable to interlock with one another when said skins are assembled on the outer frame and the inner frame.

5. The door casement defined in claim 1 wherein the reinforcing plate means are metal plates with flanges projecting normal to their surfaces and stiles and rails of the outer frame and the inner frame have grooves which receive said flanges to mechanically interlock said frames.

6. The door casement defined in claim 1 wherein the at least one of the compression molded skins is formed of two L-shaped compression molded panels with each of said panels having integral raised ribs on their inside surfaces and coupling means operable to connect said ribs thereby joining said panels to form said compression molded skin.

7. The door casement defined in claim 6 wherein both of said compression molded skins are formed from L-shaped compression molded panels having raised ribs on their inside surfaces which are joined with coupling means to form said skins.

8. The door casement defined in claim 1 wherein at least one of said skins is made of multiple compression molded longitudinal panels having integral raised ribs on their inside surfaces with said panels being joined to form said skin by coupling means operable to connect the ribs on said respective panels to one another.

9. A method of making door casements of difference sizes from small molds comprising the steps of:

forming multiple L-shaped compression molded panels each panel having a long leg and short leg, each of said panels also having on its inside surface integral raised ribs, with said ribs be located axially on said short leg and normal to the longitudinal axis of said long leg;

sizing said short leg for the width desired for said door casement;

joining said panels with coupling means operable to engage said ribs on the respective panels to form a pair of rectangular skins, each skin having a large central aperture;

mounting said skins on an outer frame having stiles and rails and an inner frame having stiles and rails located within said outer frame which is sized to partially fit into said apertures of said skins; and filling the resulting hollow core between said frames with a plastic foam.

10. A method of making door casements of difference sizes from small molds comprising the steps of:

forming multiple longitudinal compression molded panels, said panels for forming the vertical surface elements of said casement having integral raised ribs on their inside surfaces oriented normal to their longitudinal axis, said panels for forming the horizontal surfaces of said casement having integral raised ribs on their inside surfaces oriented parallel to their longitudinal axis;

sizing said panels for forming the horizontal surfaces to the width desired for said door casement;

joining said panels with coupling means operable to engage said ribs on the respective panels to form a pair of rectangular skins, each skin having a large central aperture;

mounting said skins on an outer frame having stiles and rails and an inner frame having stiles and rails located within said outer frame which is sized to partially fit in said apertures of said skins; and filling the resulting hollow core between said frames with a plastic foam.

* * * * *